US007157849B2

(12) United States Patent
Seon et al.

(10) Patent No.: US 7,157,849 B2
(45) Date of Patent: Jan. 2, 2007

(54) FIELD EMISSION DISPLAY INCLUDING MESH GRID AND FOCUSING ELECTRODE AND ITS METHOD OF MANUFACTURE

(75) Inventors: Hyeong-Rae Seon, Busan-si (KR); Cheol-Hyeon Chang, Yangsan-si (KR); Dong-Su Chang, Yangsan-si (KR); Dong-Wook Kim, Busan-si (KR); Jae-Sang Ha, Busan-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 222 days.

(21) Appl. No.: 10/759,098

(22) Filed: Jan. 20, 2004

(65) Prior Publication Data

US 2004/0145298 A1 Jul. 29, 2004

(30) Foreign Application Priority Data

Jan. 21, 2003 (KR) ..... 10-2003-0003982
Jul. 2, 2003 (KR) ..... 10-2003-0044534

(51) Int. Cl.
*H01J 1/62* (2006.01)

(52) U.S. Cl. ..... 313/495; 313/422

(58) Field of Classification Search ..... 313/422, 313/495–497; 445/23, 25, 50, 51
See application file for complete search history.

(56) References Cited

U.S. PATENT DOCUMENTS 4,827,178 A * 5/1989 Higashinakagawa et al. .... 313/402
6,249,083 B1 * 6/2001 Kim ..... 313/495
6,377,002 B1 4/2002 Ge et al.
6,580,211 B1 6/2003 Yang et al.
6,765,346 B1 7/2004 Lee et al.
6,917,155 B1 * 7/2005 Kamide et al. ..... 313/495
7,045,948 B1 * 5/2006 Lee et al. ..... 313/495
2002/0024296 A1 2/2002 Uemura et al.
2003/0042841 A1 3/2003 Ku et al.

FOREIGN PATENT DOCUMENTS

EP 0854493 A1 7/1998
EP 1146541 A2 10/2001
JP 2000-086216 3/2002
KR 1020010081496 A 8/2001
KR 1020020011617 2/2002
KR 1020030077852 10/2003

OTHER PUBLICATIONS

*Notice to Submit Response,* Apr. 28, 2005 issued by the Korean Intellectual Property Office in Applicant's co-pending Korean priority application assigned Searl. No. 10-2003-0044534.

Database WPI Section EI, Week 200265, XP002338968, published on Feb. 9, 2002(same as KR 1020020011617 to Choi et al.).

(Continued)

*Primary Examiner*—Joseph Williams
(74) *Attorney, Agent, or Firm*—Robert E. Bushnell, Esq.

(57) ABSTRACT

A field emission display device includes: a first substrate; an electron emission assembly arranged on the first substrate; a second substrate arranged a predetermined distance from the first substrate, the first and second substrates forming a vacuum space; an illumination assembly arranged on the second substrate, the illumination assembly being illuminated by electrons emitted from the electron emission assembly; and a mesh grid and above the electron emission assembly.

23 Claims, 8 Drawing Sheets

OTHER PUBLICATIONS

Database WPI Section EI, Week 200240, XP002338969, published on Aug. 29, 2001(same as KR 1020010081496 A to Choi et al.).
Journal of Vacuum Science and Technology: Part B, vol. 18, No. 2, entitled *Integration of High Voltage Field Emission Display Followed by Macro- And Nanostructural Analsysis on Microtip,* XP001189083, published on Mar. 2000.
Database WPI Section EI, Week 200410, XP002338970, published on Jul. 20, 2004.

* cited by examiner

FIELD EMISSION DISPLAY INCLUDING MESH GRID AND FOCUSING ELECTRODE AND ITS METHOD OF MANUFACTURE

CLAIM OF PRIORITY

This application claims priority under 35 U.S.C. § 119 on an application entitled "FIELD EMISSION DISPLAY AND METHOD OF MANUFACTURING THE SAME", filed in the Korean Intellectual Property Office on 21 Jan. 2003 and assigned Serial No. 2003-3982, the contents of which are hereby incorporated by reference and on an application filed in the Korean Intellectual Property Office on 2 Jul. 2003 and assigned Serial No. 2003-44534, the contents of which are also hereby incorporated by reference.

BACKGROUND OF THE INVENTION

1. Field of the Invention

The present invention relates to a field emission display and a method of manufacturing the same, and more particularly to a field emission display including a mesh grid and a focusing electrode and a method of manufacturing the same.

2. Description of the Related Art

Field emission displays (FEDs) are devices comprised of a front substrate and a rear substrate forming a vacuum chamber. The front substrate includes an anode and a phosphor on the inside thereof. The rear substrate includes a cathode and an emitter on the inside thereof. Electrons emitted from the emitter are directed toward the anode and then excite the phosphor, thereby emitting predetermined light. Field emission displays can be used in automobile dashboards.

SUMMARY OF THE INVENTION

The present invention provides an improved field emission display.

The present invention also provides a field emission display capable of preventing arc-discharge even when a high voltage is applied.

The present invention also provides a method of manufacturing a field emission display capable of preventing arc-discharge even when a high voltage is applied.

According to an aspect of the present invention, there is provided a field emission display comprising: a first substrate; an electron emission assembly arranged on said first substrate; a second substrate arranged a predetermined distance from said first substrate, said first and second substrates forming a vacuum space; an illumination assembly arranged on said second substrate, said illumination assembly being illuminated by electrons emitted from said electron emission assembly; and a mesh grid arranged above said electron emission assembly.

According to another aspect of the present invention, said mesh grid comprises a metal.

According to another aspect of the present invention, said mesh grid comprises one of stainless steel, invar, and an iron-nickel alloy.

According to another aspect of the present invention, the iron-nickel alloy comprises 2.0 to 10.0 wt % of Cr.

According to another aspect of the present invention, the iron-nickel alloy comprises 40.0 to 44.0 wt % of Ni.

According to another aspect of the present invention, the iron-nickel alloy comprises 0.2 to 0.4 wt % of Mn, 0.7 wt % or less of C, and 0.3 wt % or less of Si.

According to another aspect of the present invention, the thermal expansion coefficient of said mesh grid is in the range of $9.0\times10^{-6}/°$ C. to $10.0\times10^{-6}/°$ C.

According to another aspect of the present invention, electron emission assembly comprises a cathode, a gate, and an electron emission source.

According to another aspect of the present invention, the gate is arranged on the upper side of the cathode.

According to another aspect of the present invention, the gate is arranged on the lower side of the cathode.

According to another aspect of the present invention, an intermediate material is arranged between said electron emission assembly and said mesh grid.

According to another aspect of the present invention, said intermediate material comprises an insulating material.

According to another aspect of the present invention, wherein said intermediate material comprises a resistive material.

According to another aspect of the invention, wherein a focusing electrode is further arranged on the mesh grid.

According to another aspect of the present invention, there is provided a field emission display, comprising: a first substrate; an electron emission assembly arranged on said first substrate; a second substrate arranged at a predetermined distance from said first substrate, said first and second substrates forming a vaccum assembly; and an illumination assembly arranged on said second substrate, said illumination assembly being illuminated by electrons emitted from said electron emission assembly; and a mesh grid arranged above said electron emission assembly; wherein said mesh grid is bonded to said electron emission assembly by a frit.

According to another aspect of the present invention, there is provided a method of manufacturing a field emission display, the method comprising: providing a first substrate; arranging an electron emission assembly on said first substrate; arranging a second substrate a predetermined distance from said first substrate to form a vacuum space with said first and second substrates; arranging an illumination assembly on said second substrate, and illuminating said illumination assembly with electrons emitted from said electron emission assembly; and arranging a mesh grid above said electron emission assembly.

According to another aspect of the present invention, there is provided a method of manufacturing a field emission display device, the method comprising: providing a first substrate; arranging an electron emission assembly on said first substrate; arranging a second substrate a predetermined distance from said first substrate to form a vaccum assembly with said first and second substrates; arranging an illumination assembly on said second substrate and illuminating said illumination assembly with electrons emitted from said electron emission assembly; arranging a mesh grid above said electron emission assembly; and bonding said mesh grid to said electron emission assembly with a frit.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
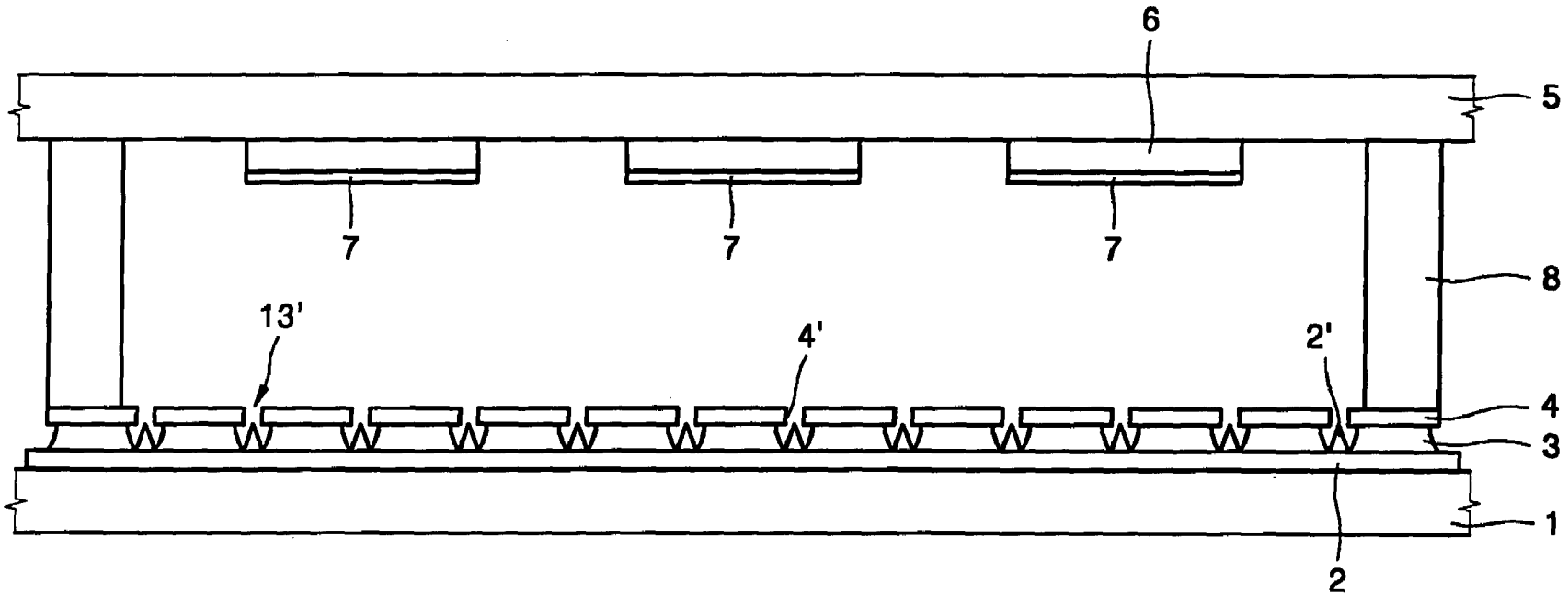
FIG. 1 is a schematic sectional view of a conventional field emission display.

FIG. 1 is a schematic sectional view of a conventional field emission display.

Referring to FIG. 1, a conventional field emission display essentially includes a front substrate 5 and a rear substrate 1, which are spaced a predetermined gap apart by a spacer 8 interposed therebetween. The rear substrate 1 has a stacked structure including a cathode 2, an insulator 3, and a gate 4 on the inside thereof. Holes are formed in the insulator 3 on the cathode 2, and microtip emitters 2' for electron emission are formed on the cathode 2 exposed through the holes. Openings 4' corresponding to the holes are formed in the gate pattern to allows for the attraction of electrons emitted from the emitters 2' toward an anode 6. The front substrate 5 includes the anode 6 on the inside thereof opposite to the rear substrate. A phosphor 7 is coated on the anode 6. The anode 6 can be formed either in a strip pattern or as a single unit to cover the whole inner surface of the front substrate. In such a display structure, the electrons emitted from the emitters 2' excite the phosphor 7, thereby emitting light.

During the electron emission, arc-discharge can be caused in a space defined between the two substrates. Although an exact cause of the arc-discharge is not known, it is believed that the arc-discharge is caused by a discharge phenomenon through immediate ionization (avalanche phenomena) of a large number of gases when the gases generated inside the panel are outgassed.

Arc-discharge can cause a short circuit between the anode and the gate. Therefore, a high voltage is applied to the gate, thereby causing damage to the gate oxide and resistive layer. This phenomenon becomes worse with increasing anode voltage. In particular, arc-discharge is more easily caused by application of an anode voltage of more than 1 kV. Therefore, it is impossible to obtain a high luminance field emission display stably driving at a high voltage in a conventional field emission display having a simple support structure of a cathode and an anode separated by a spacer.

Figure 2:
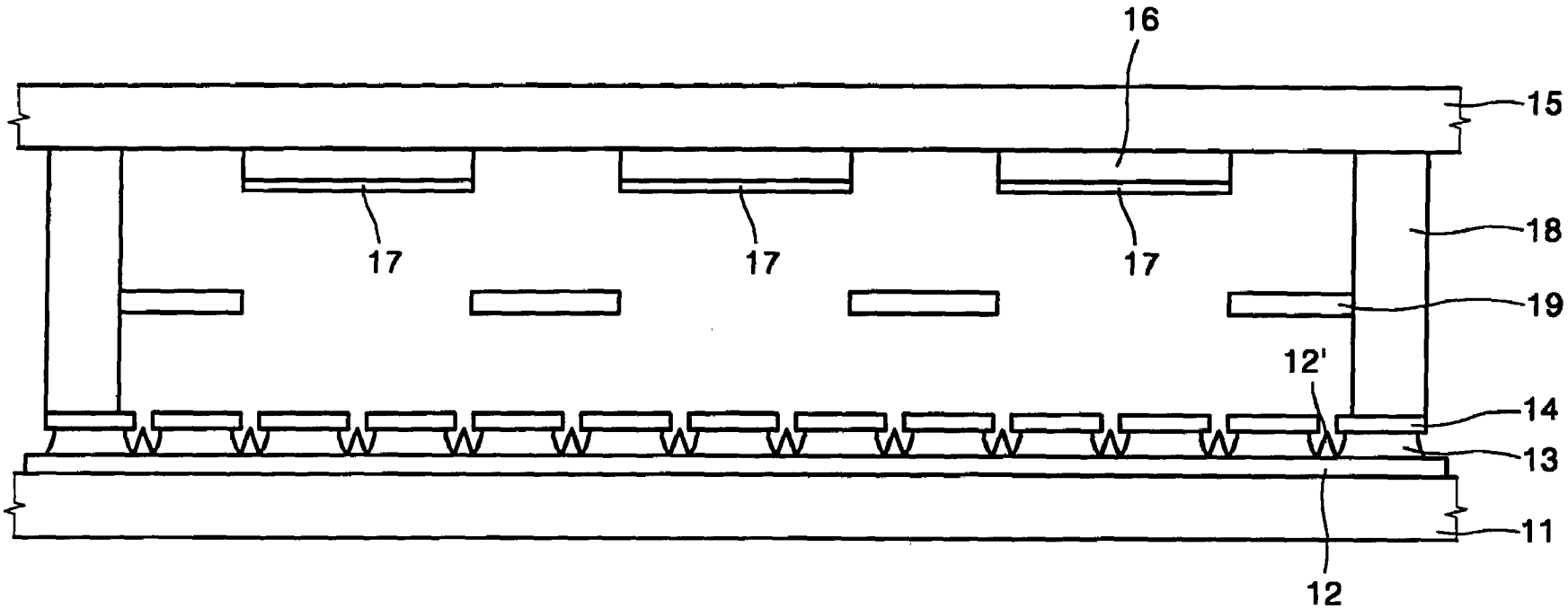
FIG. 2 is a schematic sectional view of another conventional field emission display.

FIG. 2 shows a field emission display disclosed in Korean Patent Application No. 2001-0081496 arranged to prevent the above-described arc-discharge.

Referring to FIG. 2, like in FIG. 1, a field emission display includes a front substrate 15 and a rear substrate 11, a spacer 18 interposed between the two substrates, a strip-patterned cathode 12, an insulator 13, a strip-patterned gate 14, and emitters 12' exposed through holes formed in the insulator 13. The front substrate 15 includes an anode 16 and a phosphor 17 on the inside thereof. As mentioned above, the anode 16 can be formed either in a strip pattern, or as a single layer pattern formed over the whole inner surface of the front substrate.

The field emission display further includes as arcing prevention means comprising a mesh grid 19 formed between the gate and the anode to control electrons emitted from the emitters 12'.

In such a field emission display structure, even when a voltage of −100 to 300 V is applied, an electric field at the gate edges decreases, thereby preventing arc-discharge. Furthermore, even when arcing is caused, arc ions are trapped in the mesh grid prior to causing damage to the cathode and then flow through a ground outlet, thereby preventing mechanical and electrical damages.

Figure 3:
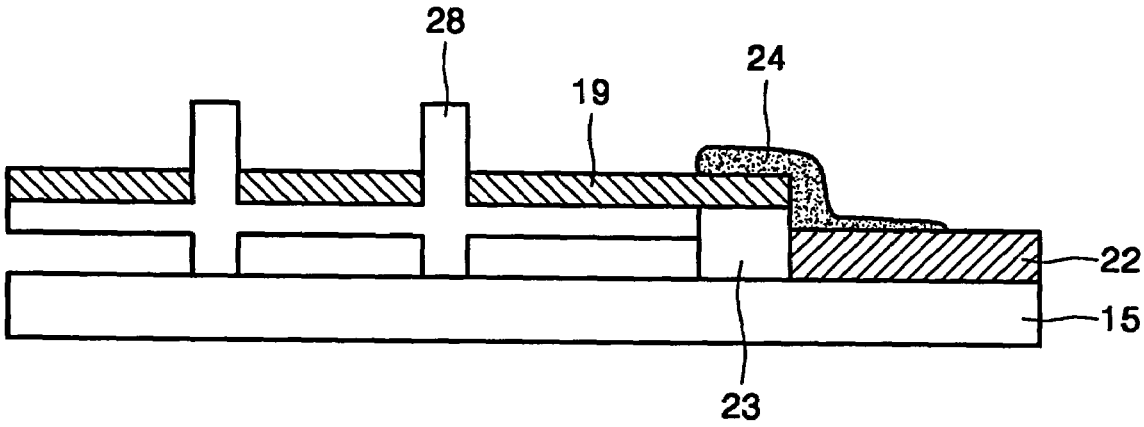
FIG. 3 is a partial perspective view of the field emission display of FIG. 2.

FIG. 3 is a schematic sectional view that illustrates a process of forming the mesh grid of FIG. 2.

Referring to FIG. 3, a mesh grid 19 is installed adjacent to a front substrate 15. A spacer 28 serves to maintain a gap between the mesh grid 19 and the front substrate 15. Protrusions of the spacer 28 are inserted into through-holes formed in the mesh grid 19. A glass holder 23 serves to support both ends of the spacer 28. An electrode 22 and the mesh grid 19 are interconnected through a conductive paste 24. Therefore, a voltage can be applied to the electrode 22 and the mesh grid 19.

In the field emission display described with reference to FIGS. 2 and 3, a mesh grid is aligned with respect to an anode of a front substrate and fixed in position through firing. The resultant structure thus obtained is then aligned with respect to a cathode of the rear substrate. However, due to the difference in thermal expansion coefficient between metal and glass materials during the firing process, it is difficult to perform an appropriate alignment between the mesh grid and the cathode of the rear substrate. Therefore, electrons emitted from the emitters collide with a phosphor adjacent to a desired emission region, thereby decreasing color purity. Also, when a pulse voltage and a DC voltage are respectively applied to the gate electrode and the mesh grid, a noise phenomenon due to vibration of the mesh grid can be caused in a display structure in which only the edges of the mesh grid are fixed by the spacer.

Hereinafter, a field emission display including a mesh grid and a method of manufacturing the same according to embodiments of the present invention will be described in detail with reference to the accompanying drawings.

Figure 4:
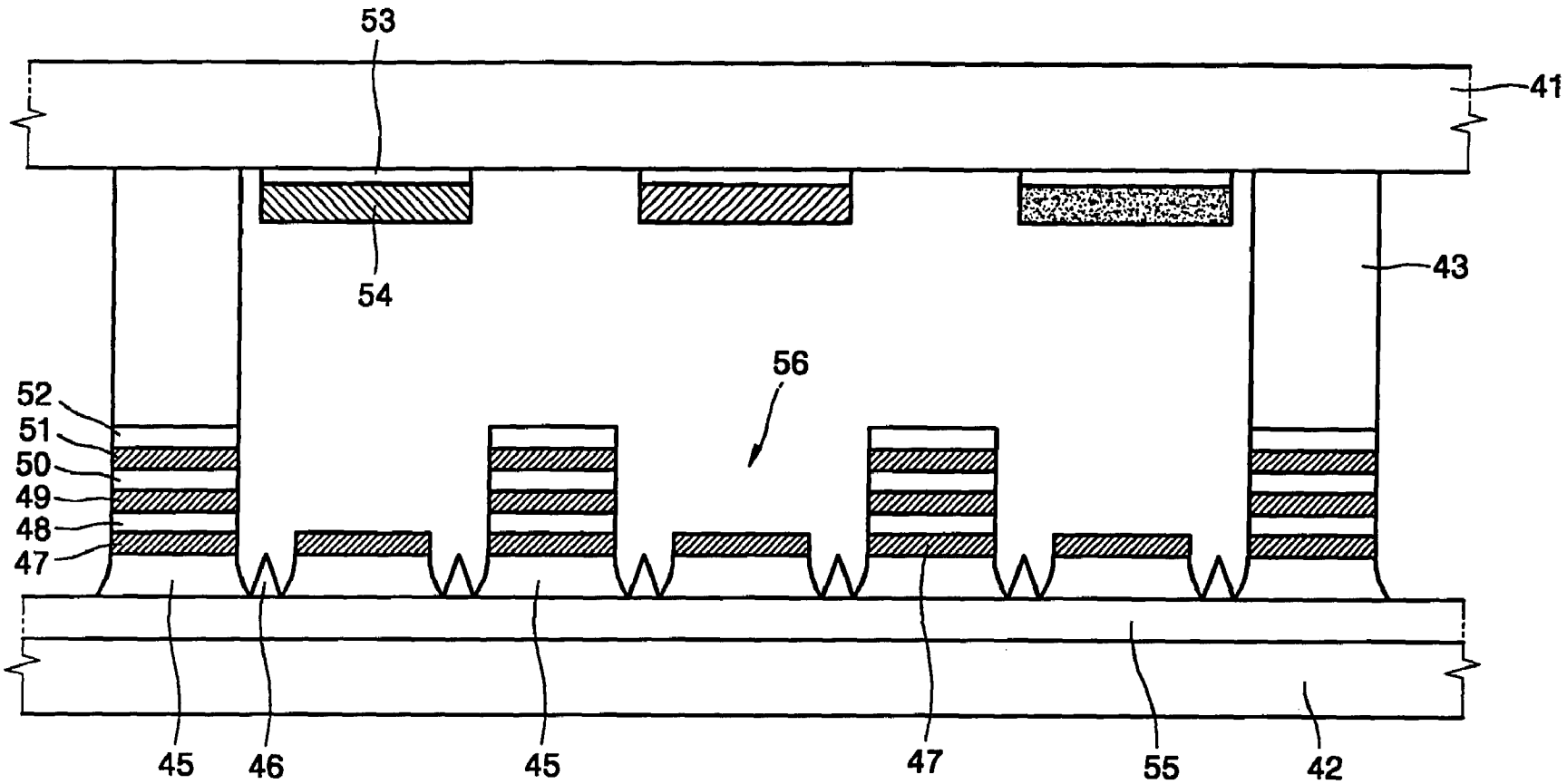
FIG. 4 is a schematic sectional view of a field emission display according to an embodiment of the present invention.

FIG. 4 is a schematic sectional view of a field emission display according to an embodiment of the present invention.

Referring to FIG. 4, a field emission display according to this embodiment has a joined structure of a front substrate 41 and a rear substrate 42, which are separated from each other by a predetermined gap, and thus, a vacuum space is formed between the two substrates. A spacer 43 is installed to maintain the gap between the front substrate 41 and the rear substrate 42. A cathode 55 is formed on the inside of the rear substrate 42. An insulator 45 is formed on the cathode 55. The insulator 45 has holes therein. Emitters 46 serving as an electron emission source are exposed through the holes.

A gate 47 is formed on the insulator 45. The gate 47 has openings corresponding to the holes of the insulator 45 to allow for attraction of electrons emitted from the emitters 46 toward an anode 53. The cathode 55, the emitter and the gate 47 serve as an electron emission assembly. In the illustrated embodiment, it is appreciated that the gate 47 is disposed on the upper side of the cathode 55.

On the other hand, in another embodiment not shown in the drawings, the gate is disposed on the lower side of the cathode. In this case, insulation between the gate and the cathode 55 must be ensured. However, there is no need to form openings in the gate. An example of a field emission display having a gate formed on the lower side of a cathode is disclosed in Korean Patent Application No. 2002-16804.

The front substrate 41 includes the anode 53 on the inside thereof. The anode 53 can formed either in a strip pattern or as a single layer formed over the whole inner surface of the front substrate 41. When the anode 53 is formed in a strip pattern, the cathode 55 and the anode 53 intersect each other perpendicularly as viewed from top. A phosphor 54 is coated on the anode 53. The phosphor 54 can be red, green, or blue.

A mesh grid 50 is formed between the gate 47 and the anode 53 to control electrons emitted from the emitters 46. The mesh grid 50 is disposed on the gate 47. That is, the mesh grid 50 includes lower and upper insulators 49 and 51, which are respectively formed on lower and upper surfaces of the mesh grid 50, and then the mesh grid 50 is disposed on the gate 47. The lower insulator 49 can be replaced with a resistive layer comprising of a resistive material. Further, both the lower and upper insulators 49 and 50 are replaced with the resistive layer. As shown in the drawing, the mesh grid 50 is fixed in such a way that it is bonded to the gate 47 by a frit. The mesh grid 50 serves to block the action of the electric field of the anode 53 on the electron emission of the cathode 55 and to accelerate the emitted electrons. In another embodiment (not shown) in which the cathode is disposed on the upper side of the gate, the mesh grid is disposed upper side of the cathode.

A focusing electrode 52 is formed on the upper insulator 51, which is in turn formed on the upper surface of the mesh grid 50. The focusing electrode 52 serves to enhance the focusing performance of electron beam. That is, the focusing electrode 52 prevents the dispersion of electrons accelerated by the mesh grid 50 and focuses the accelerated electrons on the anode 53 of interest for collision of them with the anode 53.

Figure 5:
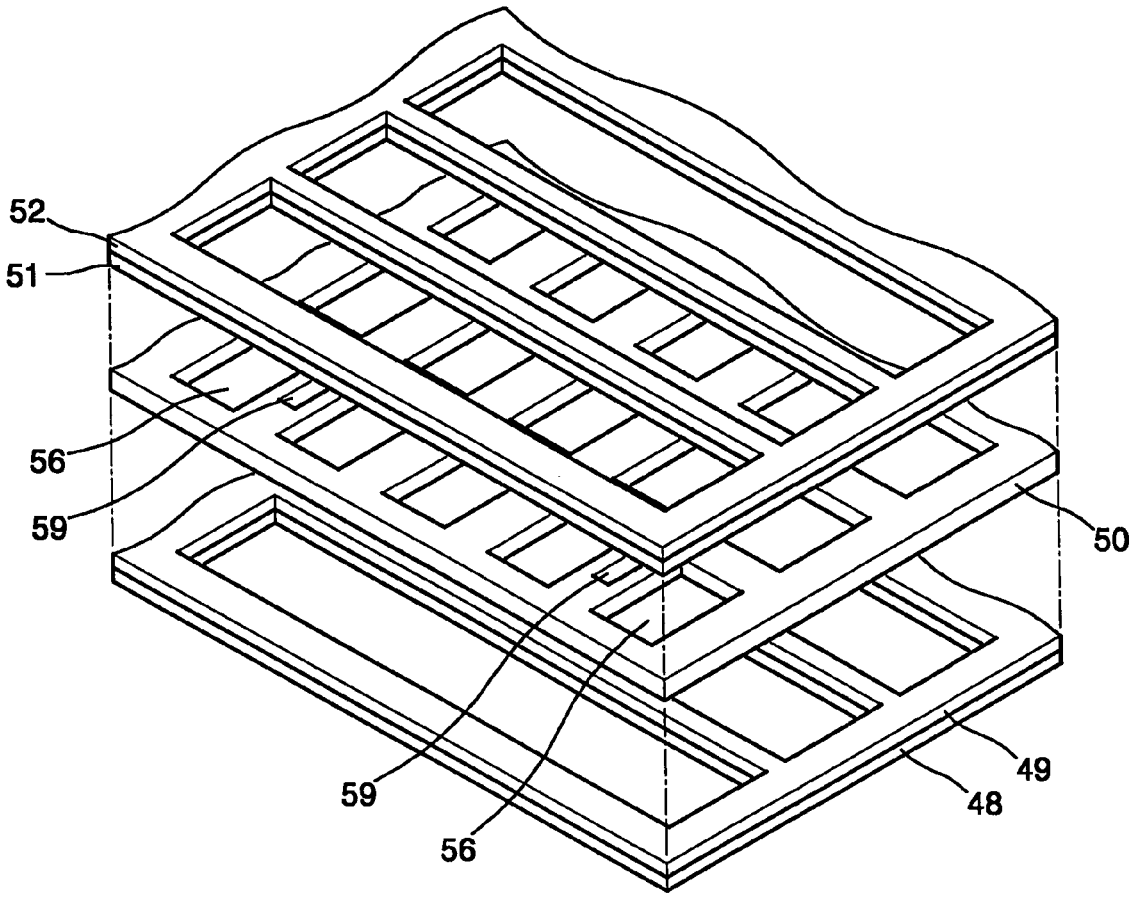
FIG. 5 is a partial perspective view of a mesh grid of the field emission display of FIG. 4.

FIG. 5 is a schematic exploded perspective view that illustrates an arrangement of the mesh grid 50 and the focusing electrode 52.

Referring to FIG. 5, the upper and lower insulators 51 and 49 are respectively formed on the upper and lower surfaces of the mesh grid 50. The frit 48 is disposed on the lower surface of the lower insulator 49 and the focusing electrode 52 is disposed on the upper surface of the upper insulator 51.

The mesh grid 50 is formed in a mesh shape and made of stainless steel or invar or SUS. Since invar and SUS have the thermal expansion coefficient smaller than normal stainless steel, it is advantageous in decreasing a thermal stress generated during a firing process. The mesh grid 50 can also be made of an iron-nickel alloy. Since the iron-nickel alloy has the thermal expansion coefficient much smaller than normal stainless steel, it is very advantageous in decreasing a thermal stress generated during a firing process. Further, since the iron-nickel alloy has the thermal expansion coefficient similar to glass, when the mesh grid made of the iron-nickel alloy is fixed to the rear substrate, the thermal expansion coefficient of the mesh grid advantageously affects the alignment with the cathode.

Meanwhile, openings 56 are formed in the mesh grid 50. Each of the openings 56 corresponds to one of red, blue, and green phosphors that make one pixel. That is, as shown in FIG. 4, each of the openings 56 corresponds to only one phosphor 54. In detail, the openings 56 are formed correspondingly to intersections of the cathode 55 and the anode 53. Electrons emitted from the emitters 46 pass through the openings 56.

The lower and upper insulators 49 and 51 are respectively formed on the lower and upper surfaces of the mesh grid 50 in such a way not to be overlapped with the openings 56, as shown in FIG. 5. As illustrated in FIG. 5, the upper and lower insulators 49 and 51 have openings. The openings are extended in the longitudinal direction of the cathode 55. The focusing electrode 52 is formed on the upper surface of the upper insulator 51 in the same shape as the upper insulator 51. The frit 48 is formed on the lower surface of the lower insulator 49 in the same shape as the lower insulator 49. The frit 48 serves to maintain the mesh grid 50 in position.

Through-holes 59 are also formed in the mesh grid 50. The spacer 43 of FIG. 4 is inserted into the through-holes 59 and maintains a gap between the front substrate 41 and the rear substrate 42.

Figure 6:
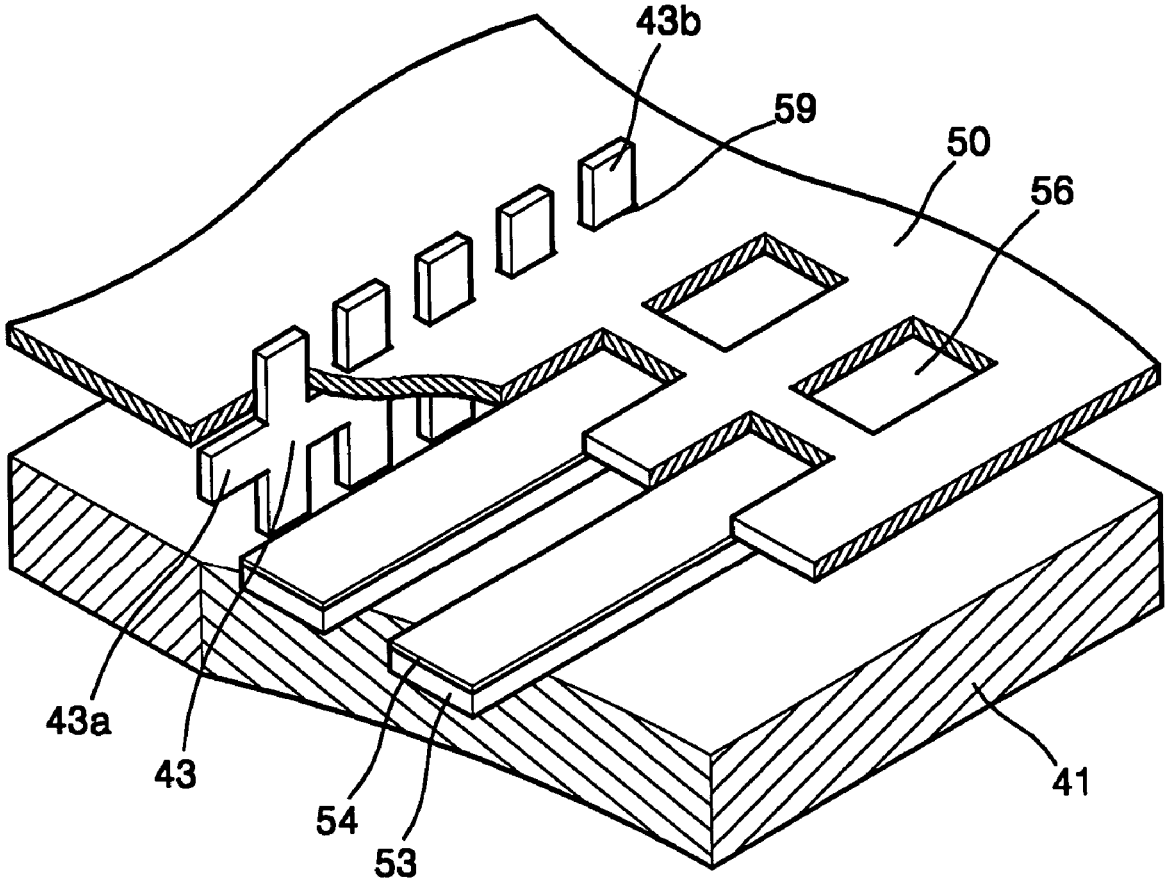
FIG. 6 is a partial perspective view that illustrates the insertion of a spacer in the field emission display of FIG. 4.

FIG. 6 is a schematic partial exploded perspective view of the field emission display of FIG. 4.

Referring to FIG. 6, the front substrate 41 is positioned in an upside-down state unlike in FIG. 4. The front substrate 41 includes, on the inside thereof, the anode 53 and the phosphor 54, which form an illumination assembly. The illumination assembly is lighted by electrons emitted from the electron emission assembly. As described above, the anode can be formed either in a strip pattern or as a single layer formed over the whole inner surface of the front substrate. In this case, it is preferable to form the phosphor 54 in a strip pattern perpendicular to the cathode. The openings 56 corresponding to the phosphor 43 are formed in the mesh grid 50. The mesh grid 50 also has the through-holes 59 for the insertion of the spacer 43. As shown in FIG. 6, the spacer 43 comprises a horizontal portion 43*a* extended in the longitudinal direction of the anode 53 and a vertical portion 43*b* extended perpendicularly to the horizontal portion 43*a*. The vertical portion 43*b* is inserted into the through-holes 59 of the mesh grid 50. Both ends of the vertical portion 43*b* are contacted with the inner surfaces of the front substrate 41 and the rear substrate 42. Accordingly, a gap between the two substrates is maintained.

Figure 7:
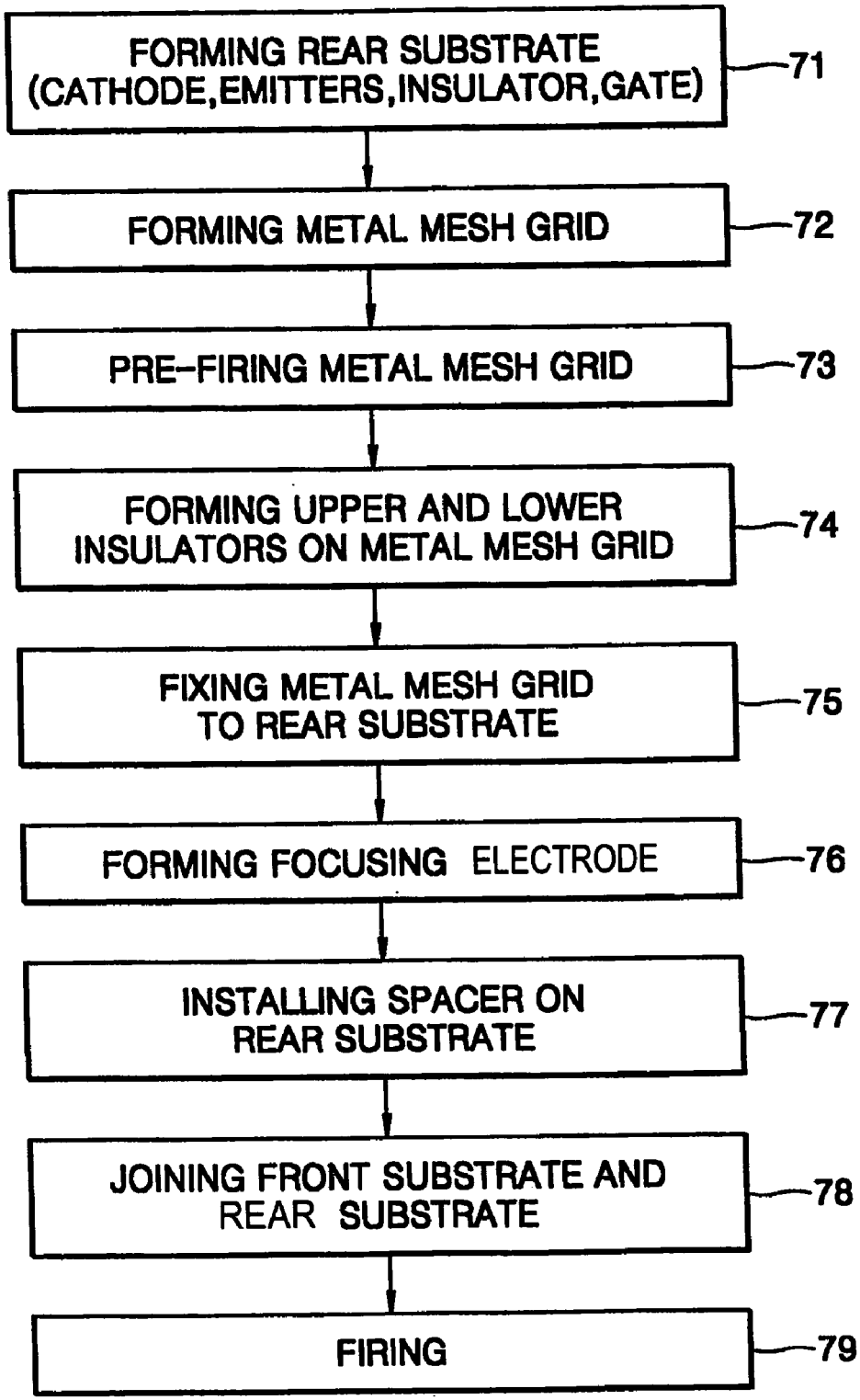
FIG. 7 is a flowchart of a process of manufacturing a field emission display according to an embodiment of the present invention.

FIG. 7 is a schematic flowchart of a process of manufacturing a field emission display having the above-described structure. The process of manufacturing a field emission display will now be described in detail with reference to FIGS. 4 through 7.

First, the cathode 55, the emitters 46, the insulator 45, and the gate 47 are formed on the rear substrate 42 (step 71). The cathode, the emitters, the insulator, and the gate are formed in a conventional method.

Next, the mesh grid 50 is formed (step 72). The mesh grid can be made of stainless steel or invar as described above. The mesh grid is processed to a predetermined shape as described above with reference to FIG. 5. The mesh grid can be made of an iron-nickel alloy to minimize thermal expansion-related problems. Preferably, 2.0 to 10.0 wt % of chromium is added to the iron-nickel alloy. Preferably, the thermal expansion coefficient of the mesh grid is in the range of $9.0\times10^{-6}/°$ C. to $10.0\times10^{-6}/°$ C., which is more similar to the thermal expansion coefficient of the substrate than that of invar, a conventional mesh grid material, i.e., about $1.2\times10^{-6}/°$ C. In particular, the mesh grid 50 made of an iron-nickel alloy has a thermal expansion coefficient similar to substrates made of a glass.

In more detail, the mesh grid 50 can be made of a iron-nickel alloy which contains 40.0 to 44.0 wt % of Ni, 49.38 to 53.38 wt % of Fe, 2.0 to 10.0 wt % of Cr, 0.2 to 0.4 wt % of Mn, 0.07 wt % or less of C, 0.3 wt % or less of Si, and an impurity.

Meanwhile, as shown in FIG. 6, the through-holes for insertion of the vertical portion 43*b* of the spacer 43 are formed in the mesh grid.

The mesh grid is subjected to pretreatment such as pre-firing to prevent the deformation of the mesh grid in subsequent processes (step 73). An object of the pre-firing is to prevent the generation of a residual stress during processing the mesh grid. The mesh grid with a residual stress can be distorted in a subsequent firing process. During the pre-firing process, the mesh grid 50 is coated with an oxide film. The oxide film increases an adhesion between the mesh grid and the insulators formed on the mesh grid. The pre-firing can be carried out at a temperature of 800 to 1,000° C.

Subsequent to the completion of the pre-firing, an insulating material is coated on the upper and lower surfaces of the mesh grid using, for example, a thick film technology such as screen printing. The coated insulating material can be fired at a temperature of 400 to 600° C. and crystallized to form the upper and lower insulators 49 and 51 (step 74).

The mesh grid having the insulators on the upper and lower surfaces thereof is arranged on the rear substrate with respect to the emitters exposed through the openings of the gate. The mesh grid is completely bonded to the rear substrate using the frit. The bonding of the mesh grid to the rear substrate can be accomplished by firing the frit at a temperature of 400 to 500° C. (step 75). In another embodiment, the mesh grid is not bonded using the frit. In other words, the mesh grid can be supported above the electron emission assembly to maintain relative position thereto.

Next, the focusing electrode is formed on the upper surface of the upper insulator of the mesh grid (step 76). The focusing electrode can be formed using an electrode material by thick film technology such as screen printing, or thin film technology such as sputtering, chemical vapor deposition, and an e-beam method.

Next, the spacer 43 is installed on the rear substrate (step 77). The spacer 43 is installed to maintain a gap between the rear substrate 42 and the front substrate 41. The spacer 43 is inserted into the through-holes 59 formed in the mesh grid 50.

Next, the front substrate 41 having the anode 53 and the phosphor 54 is joined to the rear substrate 42 (step 78). The anode 53 and the phosphor 54 can be formed on the front substrate 41 using a conventional method. Even though not shown in drawings, a black matrix can be patterned between the phosphor 54. The phosphor and the black matrix can be formed by electro-phoresis, screen printing, or a slurry method. When the front substrate and the rear substrate are joined to each other, an assembly can be fired at a temperature of 400 to 500° C. (step 79). Accordingly, a field emission display is obtained as a final product.

When the fabrication of a field emission display is completed, a voltage applied to the mesh grid for optimal electron acceleration and a voltage applied to the focusing electrode for optimal focusing are selected as follows.

First, a common voltage is applied to the gate and the anode. The voltage applied to the gate is about 70 to 120 V and the voltage applied to the anode is about 1 kV or more. Then, a voltage applied to the mesh grid is selected within a range of 30 to 300 V in order to find out an optimal voltage condition for acceleration of electrons emitted from the emitter. Also, a voltage applied to focusing electrode is selected within a range of −100 to 0 V in order to find out an optimal voltage condition for focusing the accelerated electrons.

Figure 8:
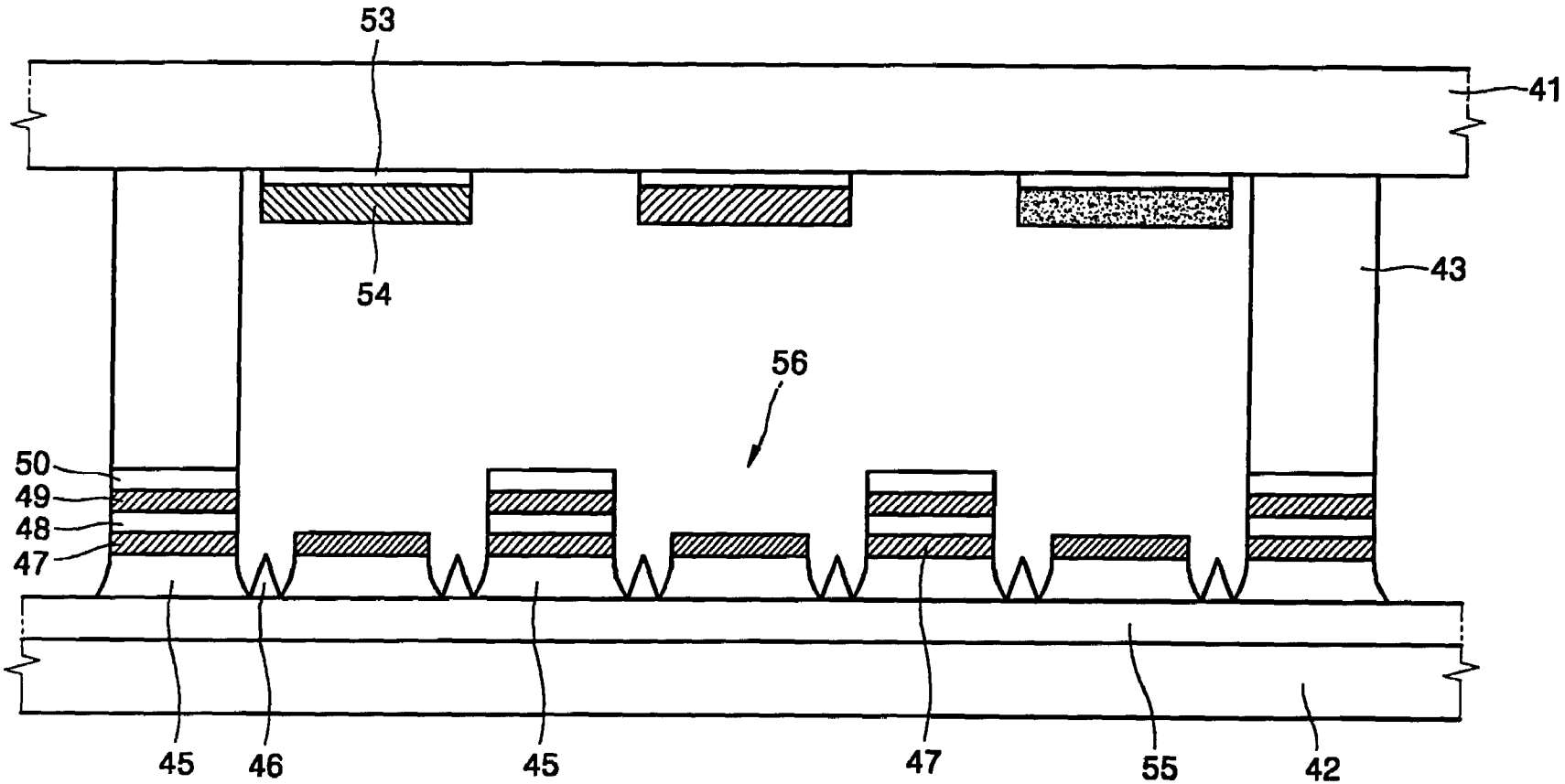
FIG. 8 is a schematic sectional view of a field emission display according to another embodiment of the present invention.

FIG. 8 is a schematic sectional view of a field emission display according to another embodiment of the present invention.

Referring to FIG. 8, the field emission display of this embodiment has a structure similar to that as shown in FIG. 4. The same constitutional elements have been represented by the same reference numerals. The focusing electrode formed on the upper side of the mesh grid 50 is omitted in the field emission display of FIG. 8.

As described above, the mesh grid 50 can be made of an iron-nickel alloy which contains 2.0 to 10.0 wt % of Cr. In more detail, the mesh grid 50 can be made of an iron-nickel alloy which contains 40.0 to 44.0 wt % of Ni, 49.38 to 53.38 wt % of Fe, 2.0 to 10.0 wt % of Cr, 0.2 to 0.4 wt % of Mn, 0.07 wt % or less of C, 0.3 wt % or less of Si, and an impurity. In this way, when the mesh grid 50 is made of an iron-nickel alloy which contains chromium, the thermal expansion coefficient of the mesh grid becomes approximate to those of the substrates. Therefore, a mis-alignment between the mesh grid and the substrates can be prevented.

The present invention provides a field emission display including a mesh grid and a focusing electrode that enable the prevention of display damage due to arcing and to acceleration and focusing of emitted electrons. The mesh grid is formed in a space defined between a gate and an anode so that electrons emitted from emitters pass through openings of the mesh grid corresponding to the intersections of the anode and the cathode. Insulators are formed on the upper and lower surfaces of the mesh grid. The mesh grid thus formed is fixed on the rear substrate by a frit. Therefore, an adjustment of alignment between the mesh grid and the rear substrate is simplified and a noise by vibration of the mesh grid that can be caused upon display driving can be minimized. Also, arc-discharge is decreased, thereby enabling to application of a high voltage. Even when an arc-discharge occurs, no damage to a cathode is caused. Furthermore, the acceleration performance of emitted electrons is enhanced, thereby increasing the luminance of the field emission display. Still furthermore, an e-beam can be focused by adjusting a voltage applied to a focusing electrode, thereby producing a high luminance and high resolution field emission display.

While the present invention has been particularly shown and described with reference to exemplary embodiments thereof, it will be understood by those of ordinary skill in the art that various changes in form and details can be made therein without departing from the spirit and scope of the present invention as defined by the following claims.

What is claimed is:

1. A field emission display, comprising:

a first substrate;

an electron emission assembly arranged on said first substrate;

a second substrate arranged a predetermined distance from said first substrate, said first and second substrates forming a vacuum space;

an illumination assembly arranged on said second substrate, said illumination assembly being illuminated by electrons emitted from said electron emission assembly;

a mesh grid arranged above said electron emission assembly, the mesh grid including an effective screen portion having a plurality of beam passage holes arranged in a predetermined pattern and having an inactive portion absent any beam passage holes; and a focusing electrode arranged on said mesh grid.

2. The field emission display of claim 1, wherein said mesh grid comprises a metal.

3. The field emission display of claim 1, wherein said mesh grid comprises one of stainless steel, invar, and an iron-nickel alloy.

4. The field emission display of claim 3, wherein the iron-nickel alloy comprises 2.0 to 10.0 wt % of Cr.

5. The field emission display of claim 3, wherein the iron-nickel alloy comprises 40.0 to 44.0 wt % of Ni.

6. The field emission display of claim 3, wherein the iron-nickel alloy comprises 0.2 to 0.4 wt % of Mn, 0.7 wt % or less of C, and 0.3 wt % or less of Si.

7. The field emission display device of claim 1, wherein the thermal expansion coefficient of said mesh grid is in the range of $9.0\times10^{6}$/°C. to $10.0\times10^{6}$/°C.

8. The field emission display device of claim 1, wherein electron emission assembly comprises a cathode and a gate and an electron emission source.

9. The field emission display device of claim 8, wherein said gate is arranged on an upper side of said cathode.

10. The field emission display device of claim 8, wherein the gate is arranged on a lower side of said cathode.

11. The field emission display device of claim 1, wherein an intermediate material is arranged between said electron emission assembly and said mesh grid.

12. The field emission display device of claim 11, wherein said intermediate material comprises an insulating material.

13. The field emission display device of claim 11, wherein said intermediate material comprises a resistive material.

14. A field emission display device, comprising:

a first substrate;

an electron emission assembly arranged on said first substrate;

a second substrate arranged a predetermined distance from said first substrate, said first and second substrates forming a vaccum assembly;

an illumination assembly arranged on said second substrate, said illumination assembly being illuminated by electrons emitted from said electron emission assembly; and a mesh grid arranged above said electron emission assembly, the mesh grid including an effective screen portion having a plurality of beam passage holes arranged in a predetermined pattern and having an inactive portion absent any beam passage holes;

wherein said mesh grid is bonded to said electron emission assembly by a frit.

15. A method of manufacturing a field emission display, the method comprising:

providing a first substrate;

arranging an electron emission assembly on said first substrate;

arranging a second substrate a predetermined distance from said first substrate to form a vacuum space with said first and second substrates;

arranging an illumination assembly on said second substrate, and illuminating said illumination assembly with electrons emitted from said electron emission assembly;

arranging a mesh grid above said electron emission assembly, the mesh grid including an effective screen portion having a plurality of beam passage holes arranged in a predetermined pattern and having an inactive portion absent any beam passage holes; and a focusing electrode arranged on said mesh grid.

16. The method of claim 15, further comprising forming said mesh grid of a metal.

17. The method of claim 15, further comprising forming said mesh grid of one of stainless steel, invar, and an iron-nickel alloy.

18. The method of claim 15, further comprising forming a cathode and a gate and an electron emission source in said electron emission assembly.

19. The method of claim 18, further comprising forming said gate on one of an upper an lower side of said cathode.

20. The method of claim 15, further comprising forming an intermediate material between said electron emission assembly and said mesh grid.

21. The method of claim 20, further comprising forming said intermediate material of an insulating material.

22. The method of claim 20, further comprising forming said intermediate material of a resistive material.

23. A method of manufacturing a field emission display device, the method comprising:

providing a first substrate;

arranging an electron emission assembly on said first substrate;

arranging a second substrate a predetermined distance from said first substrate to form a vacuum assembly with said first and second substrates;

arranging an illumination assembly on said second substrate and illuminating said illumination assembly with electrons emitted from said electron emission assembly;

arranging a mesh grid above said electron emission assembly the mesh grid including an effective screen portion having a plurality of beam passage holes arranged in a predetermined pattern and having an inactive portion absent any beam passage holes; and bonding said mesh grid to said electron emission assembly with a frit.

* * * * *